US012305966B2

(12) United States Patent
Bollfrass

(10) Patent No.: US 12,305,966 B2
(45) Date of Patent: May 20, 2025

(54) DISRUPTIVE PROJECTILES AND METHOD OF MAKING THE SAME

(71) Applicant: Roborounds, LLC, Austin, TX (US)

(72) Inventor: Charles Barton Bollfrass, Austin, TX (US)

(73) Assignee: ROBOROUNDS, LLC, Austin, TX (US)

( * ) Notice: Subject to any disclaimer, the term of this patent is extended or adjusted under 35 U.S.C. 154(b) by 0 days.

(21) Appl. No.: 18/366,006

(22) Filed: Aug. 7, 2023

(65) Prior Publication Data

US 2024/0044625 A1 Feb. 8, 2024

Related U.S. Application Data

(60) Provisional application No. 63/395,666, filed on Aug. 5, 2022.

(51) Int. Cl.
*F42B 12/66* (2006.01)
*F42B 12/56* (2006.01)

(52) U.S. Cl.
CPC ..... *F42B 12/66* (2013.01)

(58) Field of Classification Search
CPC ..... F42B 12/367; F42B 12/56; F42B 12/58; F42B 12/64; F42B 12/68; F42B 12/66; F41H 11/04
See application file for complete search history.

(56) References Cited

U.S. PATENT DOCUMENTS 113,677 A * 4/1871 Lovett, Jr. ..... F42B 12/64 102/456
1,198,035 A * 9/1916 Huntington ..... F42B 12/66 102/504
2,184,802 A * 12/1939 Milavec ..... F42B 12/66 102/504
2,308,683 A * 1/1943 Forbes ..... F42B 12/66 102/504
2,322,624 A * 6/1943 Forbes ..... F42B 12/66 102/504
2,341,212 A * 2/1944 Friend ..... F42B 12/66 102/504
2,360,096 A * 10/1944 Aydelotte ..... F41H 11/04 102/504
2,368,587 A * 1/1945 Wise ..... F41H 11/04 102/504
2,373,364 A * 4/1945 Welleome ..... F42B 12/66 102/504

(Continued)

FOREIGN PATENT DOCUMENTS

GB 191423196 A * 11/1914 ..... F42B 12/66
KR 20190135843 A * 5/2018 ..... F41H 13/0031
WO WO-2006103664 A2 * 10/2006 ..... F42B 12/36

*Primary Examiner* — Derrick R Morgan
(74) *Attorney, Agent, or Firm* — Workman Nydegger

(57) ABSTRACT

A disruptive projectile for use with a pneumatic weapon or similar device can include a shell defining an interior volume, the shell being frangible on impact with a target. The interior volume may be provided with a flexible line that may be arranged to extend and/or expand when released from the frangible shell on impact with the target, increasing an effective impact zone on the target. The flexible line may entangle with or otherwise impede operation of a rotatable element of the target.

19 Claims, 12 Drawing Sheets

(56) References Cited

U.S. PATENT DOCUMENTS 3,085,510 A * 4/1963 Campbell ..... F42B 7/04 102/456
4,030,421 A * 6/1977 Litman ..... F42B 12/34 102/515
4,664,034 A * 5/1987 Christian ..... F42B 12/66 102/439
5,315,932 A * 5/1994 Bertram ..... F41H 13/0006 102/504
5,528,989 A * 6/1996 Briese ..... F42B 12/34 102/516
5,569,874 A * 10/1996 Nelson ..... F42B 12/34 102/516
5,691,501 A * 11/1997 Gilbert ..... F42B 12/34 102/444
5,698,815 A * 12/1997 Ragner ..... F41H 13/0006 102/504
5,814,753 A * 9/1998 Rieger ..... F42B 12/66 102/504
6,381,894 B1 * 5/2002 Murphy ..... F41B 15/10 42/77
6,820,560 B1 * 11/2004 Romppanen ..... F42B 7/02 102/444
8,024,889 B2 * 9/2011 Bunker ..... A01M 1/2027 102/367
9,423,222 B1 * 8/2016 Thomas ..... F42B 12/34
10,703,451 B1 * 7/2020 Adams ..... F41F 3/10
10,724,831 B1 * 7/2020 Walker ..... F42B 12/56
2003/0145755 A1 * 8/2003 Briese ..... F42B 12/74 102/506
2005/0073796 A1 * 4/2005 Smith ..... F41H 13/0031 361/232
2008/0178758 A1 * 7/2008 Kapeles ..... F42B 12/50 102/502
2009/0178329 A1 * 7/2009 Jelnicki, Jr. ..... F42B 12/68 43/19
2009/0241402 A1 * 10/2009 Kraft ..... F42B 7/02 43/3
2010/0126483 A1 * 5/2010 Makowski ..... F41B 3/04 124/5
2010/0132580 A1 * 6/2010 Nazdratenko ..... F41H 13/0006 124/56
2012/0210904 A1 * 8/2012 Merems ..... F42B 12/56 102/504
2013/0269561 A1 * 10/2013 Crum ..... F42B 7/046 86/54
2014/0331984 A1 * 11/2014 Brahler, II ..... F41B 11/723 124/76
2015/0316345 A1 * 11/2015 Brahler, II ..... F41B 11/60 124/73
2017/0219317 A1 * 8/2017 Sands ..... F41H 13/0006
2017/0261292 A1 * 9/2017 Armstrong ..... F41H 11/02
2017/0321996 A1 * 11/2017 Hoareau ..... F41H 13/00
2021/0025681 A1 * 1/2021 Dudee ..... F42B 10/38
2021/0278178 A1 * 9/2021 Garcia ..... F41B 15/10
2023/0020012 A1 * 1/2023 Bigelow ..... F42B 10/28
2023/0085735 A1 * 3/2023 Davidson ..... F42B 12/62 89/1.57

* cited by examiner

DISRUPTIVE PROJECTILES AND METHOD OF MAKING THE SAME

TECHNICAL FIELD

The disclosure relates to disruptive projectiles for impeding the operation of an electrical or robotic device, such as drones, robots, or the like.

BACKGROUND

Projectiles such as bullets have been designed with specially tailored features for accomplishing a wide variety of objectives related to hunting, sporting, personal defense, law enforcement and military applications. Known designs are largely concerned with inflicting mechanical trauma to a target by tuning a bullet's composition and shape to achieve a particular penetration of and energy transfer to the target.

Non-lethal projectile systems have been developed with modified objectives, particularly the preservation of a target's life. While capable of inflicting mechanical trauma to a living target, this trauma is significantly reduced, often preventing penetration at all, and additional capabilities are introduced for at least temporarily incapacitating, slowing, repelling or inhibiting a living target and/or marking such a living target for later identification. Known non-lethal projectile systems include kinetic impact projectiles, paintballs, pepper-spray projectiles, electroshock projectiles, and bola-like projectiles, and are widely and successfully employed against living targets in various applications.

Kinetic impact projectiles are a less lethal alternative to traditional bullets as they are designed to impact a living target without penetration. These projectiles are configured to cause pain and incapacitation of living targets from range, without penetration of and/or inflicting death on the living targets. Common kinetic impact projectiles include baton rounds, such as rounds made of rubber, plastic, wood, fabric or foam materials, often surrounding a heavier core material as a kinetic payload. When appropriately deployed, the kinetic payload transfers kinetic force to the living target with the intent of incapacitating the living target by inflicting pain, muscle spasm or a similar reaction. Absent the ability to inflict pain or a muscle spasm as described, known kinetic impact projectiles would provide no advantageous effect on a target.

Paintballs are commonly manufactured as spherical capsules containing a colorant material as a payload. The capsules may be formed of a frangible material, such as gelatin, glass or the like, and are designed to break on impact and release the colorant material. Some pepper-spray projectiles are designed to operate in the same way, as frangible capsules containing a chemical irritant payload that is released on impact. The chemical irritant may be a lachrymatory agent and may take the form of a powder, liquid, or aerosol that is configured to incapacitate or disorient a living target. As with kinetic impact projectiles, other than marking a target, known payloads for paintballs and pepper-spray projectiles are ineffective against non-living targets that are unimpeded by biological agents.

Electroshock projectiles are generally arranged with barbed darts intended to attach to a living target and with a wire connecting the darts to an electric source. These projectiles deliver an electric current designed to disrupt voluntary control of a living target's muscles. Bola-like projectiles are designed to deliver a restraining element to and around a living target, often using weighted end portions of the restraining element to impart kinetic force to the restraining element, such as a rope or wire. When the restraining element strikes the living target, the momentum of the weighted end portions causes the restraining element to wrap around the living target, successfully impeding a living target when the target's limbs are restrained. Much like other non-lethal projectile systems, electroshock projectiles and bola-like projectiles suffer from limited efficacy against non-living targets. In addition, these projectile systems have very limited range and require complex and costly delivery systems.

While impairment caused by the above-described projectile systems is generally sufficient for disrupting living targets, it is considerably less effective against electrical devices. In contrast to a living target that experiences pain and may be incapacitated by mechanical trauma or chemical agents, electrical devices do not feel pain and may only be substantively damaged if mechanical or chemical trauma is applied to small and specific components within the devices. For example, while the mechanical force of a conventional bullet or kinetic impact projectile may slightly destabilize a drone when hit, unless an essential component or electrical circuit of the drone is directly struck and sufficiently damaged the drone may continue to operate unimpaired.

The need to incapacitate an electrical device is further complicated by the obvious differences between biological anatomy and electrical design. Clearly, incapacitating a non-living target having wheels, propellers, LIDAR sensors, infrared sensors, etc., presents significant challenges using conventional projectile systems designed to impede the limbs, muscles, eyes, lungs, etc. of living targets. These challenges are expected to become more significant as the development and proliferation of electrical devices continues.

Notably, drones have already become a significant challenge for traditional security arrangements of sensitive areas such as prisons, military bases, government installations, secure business facilities and airports, among many others, by simply flying into areas previously restricted by fences and reachable only by projectiles fired from a distance. Conventional non-lethal projectile systems are designed for living targets and are not capable of substantively impeding such incursions, while the use of conventional lethal projectile systems have only limited efficacy, as they are also designed for living targets, while also risking significant harm to individuals or equipment that may fall in the line of fire. Complex electronic systems employing lasers and/or jamming systems have been considered for securing sensitive areas, but these systems are far too complex and expensive to be practical, while also posing a risk to other electronic systems that may be in the same area.

Accordingly, there remains a need for a projectile system capable of incapacitating electrical devices such as drones and other robotic systems at a distance, without risking lethal harm to living things falling in the target area. In like manner, there is a need for a projectile system for use against non-living targets that is relatively inexpensive and simple to use, making an economical substitute for the use of other known or proposed systems.

SUMMARY

Embodiments of the present disclosure advantageously provide disruptive projectiles in the form of a projectile body or shell defining an interior volume within, the interior volume containing a flexible line for increasing impairment of a target electrical device, or other non-living target, with a successful strike. The projectile body may be configured to rupture upon impact with a target electrical device, such that the flexible line is released against the electrical target. The flexible line may be configured to extend and/or expand upon release, such that the flexible line contacts and entangles with a rotating element of the electrical target. The projectile embodiments of the disclosure may bend, break, or otherwise impair the electrical target or preferably the rotating element thereof in a safe and efficient manner. Moreover, these projectile embodiments can be produced and employed without substantially increasing material or labor costs, instead merely replacing conventional projectiles in conventional projectile systems or firearms with the projectile embodiments of the disclosure.

According to an embodiment, a projectile for use in impairing a rotating element of a target electrical device comprises a shell defining an interior volume. The shell may be in the form of a ball, bullet or similarly shaped projectile for use with a pneumatic firearm or similar launching device. The shell may be spherical or nearly spherical, although alternative shapes may be employed as suitable for adapting the shape to fit particular launching devices. The shell may be formed of frangible materials, such that the shell is configured to maintain integrity when fired and rupture upon impact with a target to release a payload from the interior volume. Suitable frangible materials include plastic materials, rubber materials, gelatin, glass and the like, and additional materials may be readily apparent from the teachings of the instant disclosure.

The shell may be integrally formed, may comprise two connecting pieces, or otherwise be assembled in a manner appropriate to define the interior volume and enclose the payload. Exterior walls of the shell may have a thickness configured to substantially maintain a structural integrity of the shell under a propelling force while configured to rupture, separate or otherwise open upon impact with a target. Accordingly, some embodiments may be configured for use with known pneumatic firearms and/or known shell materials, for example those used for paintballs and/or pepper balls.

In varying embodiments, the payload may include a flexible line. Advantageously, the flexible line may be configured for having a length that can extend and/or expand upon release from the interior volume. The flexible line may comprise a connected series of weighted elements or be formed from one or more filaments, with embodiments including the flexible line in the form of a chain, a ball-chain, a flexible wire, a monofilament line, a rope, or the like. The flexible line may comprise one or more of a metal material, a wood material and/or a plastic material, and may have a constant hardness and/or weight or may be configured with variable hardness and/or weight.

The flexible line may be configured to be retained in the shell, such as by coiling, collapsing, or compressing the flexible line within the interior volume of the shell. The flexible line may be launched or projected to a target within the shell, advantageously benefiting from aerodynamic properties of the shell and conventional launch systems or firearms. Upon impact with and rupture of the shell against a target, the flexible line advantageously increases in length by uncoiling, extending and/or expanding under momentum of the launch, increasing an area of effect on the target. The flexible line may be configured for entangling with a rotating element of the target, such that a strength and/or weight of the flexible line impedes the rotating element by bending, breaking, or otherwise impairing rotation of the rotating element. The flexible line may be configured to increase chances for entanglement with the target, such as by employing an uneven distribution of weight, weighted ends, and/or incorporating the flexible line in varying shapes and patterns, including webs, nets and the like.

The projectile embodiments of the current disclosure may be configured with a weight that reduces the possibility of serious injury to a living entity, while being sufficient to maintain appropriate velocity and accuracy. The projectiles are surprisingly effective against electrical targets while being safe for use in populated areas, and achieve an advantageous combination of accuracy, range and spread against a target. In this manner, an effective strike zone on an electrical target is significantly increased and the probability of incapacitating or impairing the operation of the electrical device is dramatically improved over known non-lethal projectiles.

Embodiments of the projectile may further include an inhibiting substance in the form of a lubricant material, a conductive material, a piezoelectric material, and/or a radiation impeding material. The inhibiting substance may be configured to further impair an element of an electrical target, such as sensors, propellers, drive shafts, cameras, and/or electrical systems of electrical targets. The inhibiting substance may be provided in the interior volume and surround the flexible line and/or be provided within a portion of the flexible line, such that the flexible line may increase a spread and/or release of the inhibiting substance.

Embodiments of a method of disrupting an electrical target may include providing a flexible line within an interior volume of a shell and projecting the shell against the target, such that the shell ruptures and releases the flexible line to entangle the target and preferably a rotating element thereof. In various uses, the rotating element may comprise a propeller, a wheel, a drive shaft, or the like.

According to embodiments of a method for forming disruptive projectiles, a projectile body or shell may be provided defining an interior volume. A flexible line may be added to the interior volume and secured therein by closing the shell. The flexible line may be provided to the interior volume in a collapsed, coiled, compressed or similar form, such that the flexible line may increase in length upon release from the interior volume of the shell.

BRIEF DESCRIPTION OF THE DRAWINGS

In order to describe the manner in which the above-recited and other advantages and features can be obtained, a more particular description of the subject matter briefly described above will be rendered by reference to specific embodiments which are illustrated in the appended drawings. Understanding that these drawings depict only typical embodiments and are not, therefore, to be considered to be limiting in scope, embodiments will be described and explained with additional specificity and details through the use of the accompanying drawings in which.

Figure 1:
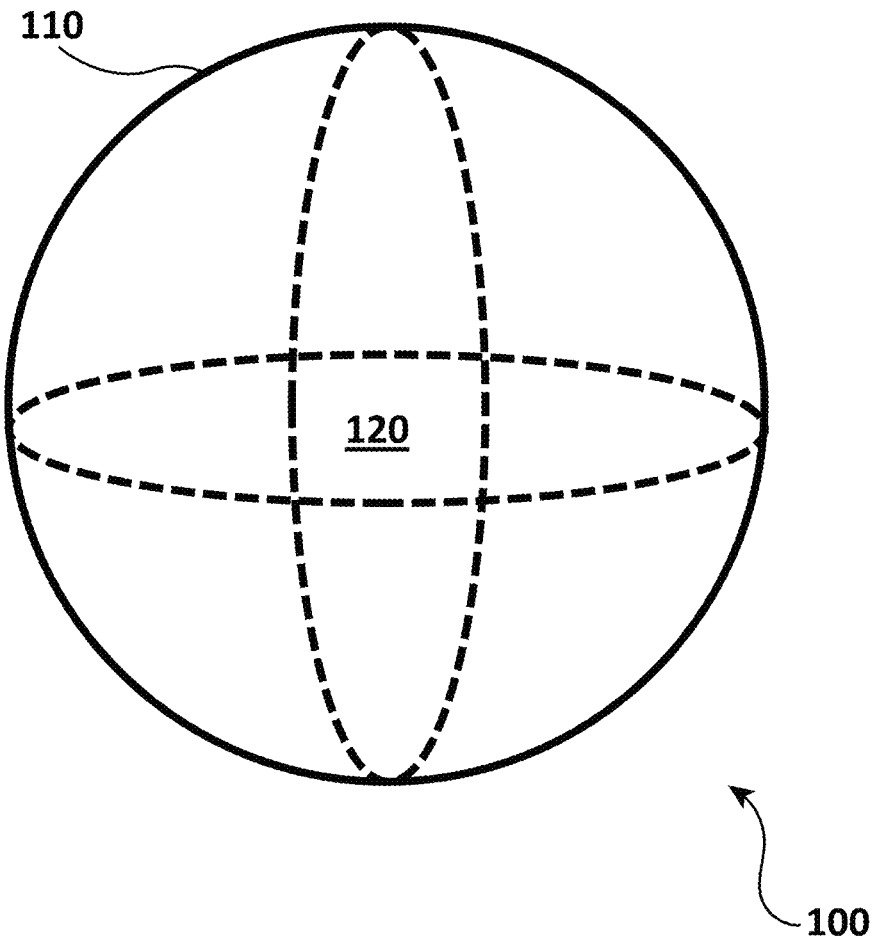
FIG. 1 is a diagram of a disruptive projectile having a shell defining an interior volume according to an embodiment of the disclosure.

The drawing figures are not necessarily drawn to scale, but instead are drawn to provide a better understanding of the components, and are not intended to be limiting in scope, but to provide exemplary illustrations. The figures illustrate exemplary configurations of disruptive projectiles for use against non-living targets and related methods, and in no way limit the structures or configurations of projectiles and methods according to the present disclosure.

DESCRIPTION

A better understanding of different embodiments of the disclosure may be had from the following description read with the accompanying drawings in which like reference characters refer to like elements.

While the disclosure is susceptible to various modifications and alternative constructions, certain illustrative embodiments are in the drawings and are described below. It should be understood, however, that there is no intention to limit the disclosure to the specific embodiments disclosed, but on the contrary, the intention covers all modifications, alternative constructions, combinations, and equivalents falling within the spirit and scope of the disclosure. The dimensions, angles, and curvatures represented in the figures introduced above are to be understood as exemplary and are not necessarily shown in proportion. The embodiments of the disclosure may be adapted or dimensioned to accommodate use with different weapons, launchers, etc., as would be understood from the present disclosure by one skilled in the art.

Certain embodiments and features may be described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Any numerical value is "about" or "approximately" the indicated value, and takes into account experimental error and variations that would be expected by a person having ordinary skill in the art.

It will be understood that unless a term is expressly defined in this application to possess a described meaning, there is no intent to limit the meaning of such term, either expressly or indirectly, beyond its plain or ordinary meaning. Unless defined otherwise, all technical and scientific terms used herein have the same meaning as commonly understood by one of ordinary skill in the art to which the present disclosure pertains. Although a number of methods and materials similar or equivalent to those described herein can be used in the practice of the present disclosure, the preferred materials and methods are described herein.

It is to be noticed that the term "comprising," which is synonymous with "including," "containing," "having" or "characterized by," should not be interpreted as being restricted to the means listed thereafter; it does not exclude other or additional, unrecited elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present disclosure, the relevant components of the device are A and B.

It will be noted that, as used in this specification and the appended claims, the singular forms "a," "an" and "the" include plural referents unless the content clearly dictates otherwise.

Reference throughout this specification to "one embodiment," "one aspect," or "an embodiment" means that a particular feature, structure or characteristic described in connection with the embodiment is included in at least one embodiment of the present disclosure. As used herein, the term "embodiment" or "aspect" means "serving as an example, instance, or illustration," and should not necessarily be construed as preferred or advantageous over other embodiments disclosed herein. Thus, appearances of the phrases "in one embodiment," "in one aspect," or "in an embodiment" in various places throughout this specification are not necessarily all referring to the same embodiment but may. Furthermore, the particular features, structures or characteristics may be combined in any suitable manner, as would be apparent to one of ordinary skill in the art from this disclosure, in one or more embodiments.

Similarly, it should be appreciated that in the description of exemplary embodiments of the disclosure, various features of the disclosure are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the embodiments require more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this disclosure.

Furthermore, while some embodiments described herein include some, but not other features included in other embodiments, combinations of features of different embodiments are meant to be within the scope of the disclosure, and form different embodiments, as would be understood by those in the art. For example, in the following claims, any of the claimed embodiments can be used in any combination.

Reference throughout this specification to a "target," generally corresponds to any object that is intended to be struck or otherwise impeded by the embodiments of the disclosure. A primary target of interest for the disclosed embodiments is a "drone", especially a remote-controlled or autonomous aircraft or flying device, such as including one or more propellers for sustaining flight. Other targets may also be contemplated, particularly other autonomous vehicles with rotating parts, but the disclosure is not limited thereto.

In the description provided herein, numerous specific details are set forth. However, it is understood that embodiments of the disclosure may be practiced without these specific details. In other instances, well-known methods, structures and techniques have not been shown in detail in order not to obscure an understanding of this description.

The various embodiments of the disclosure relate to projectiles or bullets for use with pneumatic weapons or related devices for expelling or propelling a projectile. The projectiles extend against and cause disruption to rotating elements of a non-living target or electrical device in the form of mechanical damage, resulting in an increased per strike disruption to operation of the target as compared to known projectiles. Moreover, the disclosed embodiments may be produced and used without significantly increasing material or labor costs, instead merely replacing conventional projectiles with the projectile embodiments of the disclosure. Further, advantages of the disclosed embodiments are achieved without endangering living entities in the surrounding environment.

Depicted in FIG. 1 is an embodiment of a disruptive projectile 100 incorporating features of the present disclosure. As discussed below in more detail, projectile 100 is configured to impact a target and impede an operation thereof. Projectile 100 generally comprises a body or shell 110 defining an interior volume 120 therein. The shell 110 may include a frangible material configured to rupture, break, separate or otherwise open and/or release the contents of the interior volume 120 on impact with a target.

It will be appreciated that the shell 110 may be made of or otherwise include one or more frangible materials such as glass, gelatin, plastic, rubber, related composites, or similar materials, as may be used in conventional paintballs and/or pepper balls, as would be understood by one skilled in the art from the present disclosure. A wall thickness and material of the shell 110 may be configured to maintain structural integrity and/or retain the contents of the interior volume 120 when fired, such as at a velocity in a range of 250 feet per second to 350 feet per second for pneumatic projectiles, in some embodiments a velocity up to 400 feet per second, or more particularly a velocity around 300 feet per second, rupturing only upon impact with a target to release a payload from the interior volume 120. For example, the shell 110 may have a wall thickness in a range of 0.5 to 1.5 mm. In certain embodiments, the shell may comprise a paintball or pepper ball shell.

In various embodiments the shell 110 may include ribbed elements, varying thicknesses, adhesive, snap fit connections and the like for configuring the shell 110 to specific pressures according to the requirements of known pneumatic weapons, firearms, launchers and related instruments, as would be understood by one skilled in the art from the present disclosure. The shell 110 may be integrally formed, may comprise two or more connecting pieces, or otherwise be assembled in a manner appropriate to define the interior volume 120 and enclose the payload.

Further, the shell 110 may be dimensioned or shaped according to the requirements and bore of known pneumatic weapons, firearms, launchers and related instruments. The shell 110 may be in the form of a ball, bullet or similarly shaped projectile according to the specifications of the instrument or device used for launching the projectile 100. Accordingly, the shell 110 may be spherical or nearly spherical, although alternative shapes may be employed as suitable for adapting the shape of the shell 110 for fitting particular launching devices, as would be understood by one skilled in the art from the present disclosure. The shell may be configured with a diameter in a range of 8 to 22 mm, in a range of 10 to 20 mm, in a range of 12 to 18 mm, or in a range of 14 to 18 mm.

In view of the features of the disclosed embodiments, the projectile 100 is advantageously adaptable and/or reconfigurable for different applications, and does not require expensive or complex, specialized equipment for use or production. Instead, the projectile embodiments of the instant disclosure can be produced and employed without substantially increasing material or labor costs, by replacing conventional projectiles with the projectile embodiments of the disclosure.

FIGS. 2A-2D show diagrams of a flexible line 200 that may be provided in the interior volume 120 of the shell 110. The flexible line 200 may be configured for having a length that can expand and/or extend upon release from the interior volume 120 of the shell 100. In varying aspects, the flexible line 230 may comprise a connected series of weighted elements or be formed from one or more filaments, with embodiments including the flexible line in the form of a chain, a ball-chain, a flexible wire, a monofilament line, a rope, or the like. Of course, various embodiments may include more than one flexible line 230 in the interior volume 120 of the shell 110.

Figure 2A:
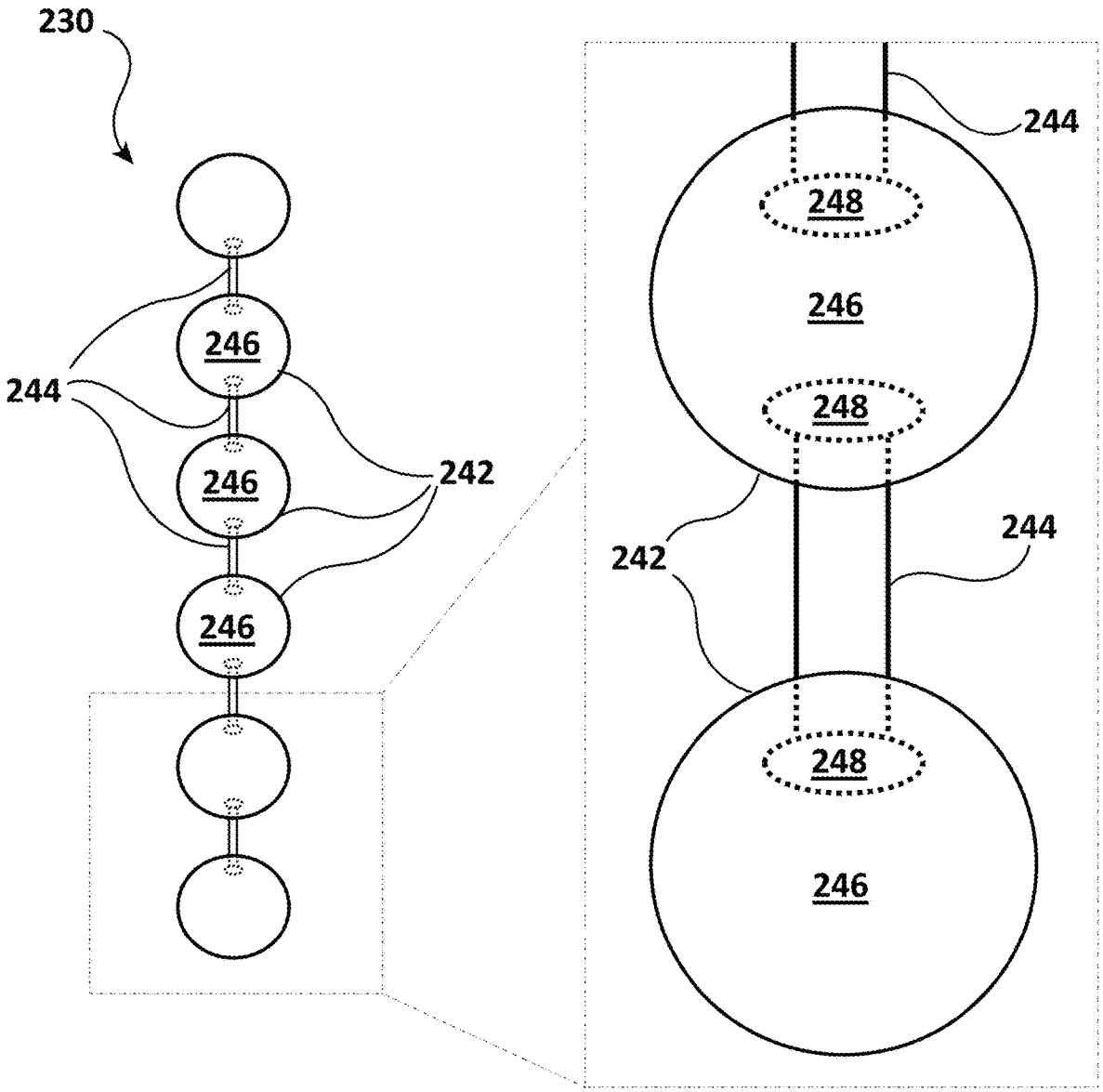
FIG. 2A is a diagram of a flexible line in an extended configuration according to an embodiment of the disclosure.
Figure 2B:
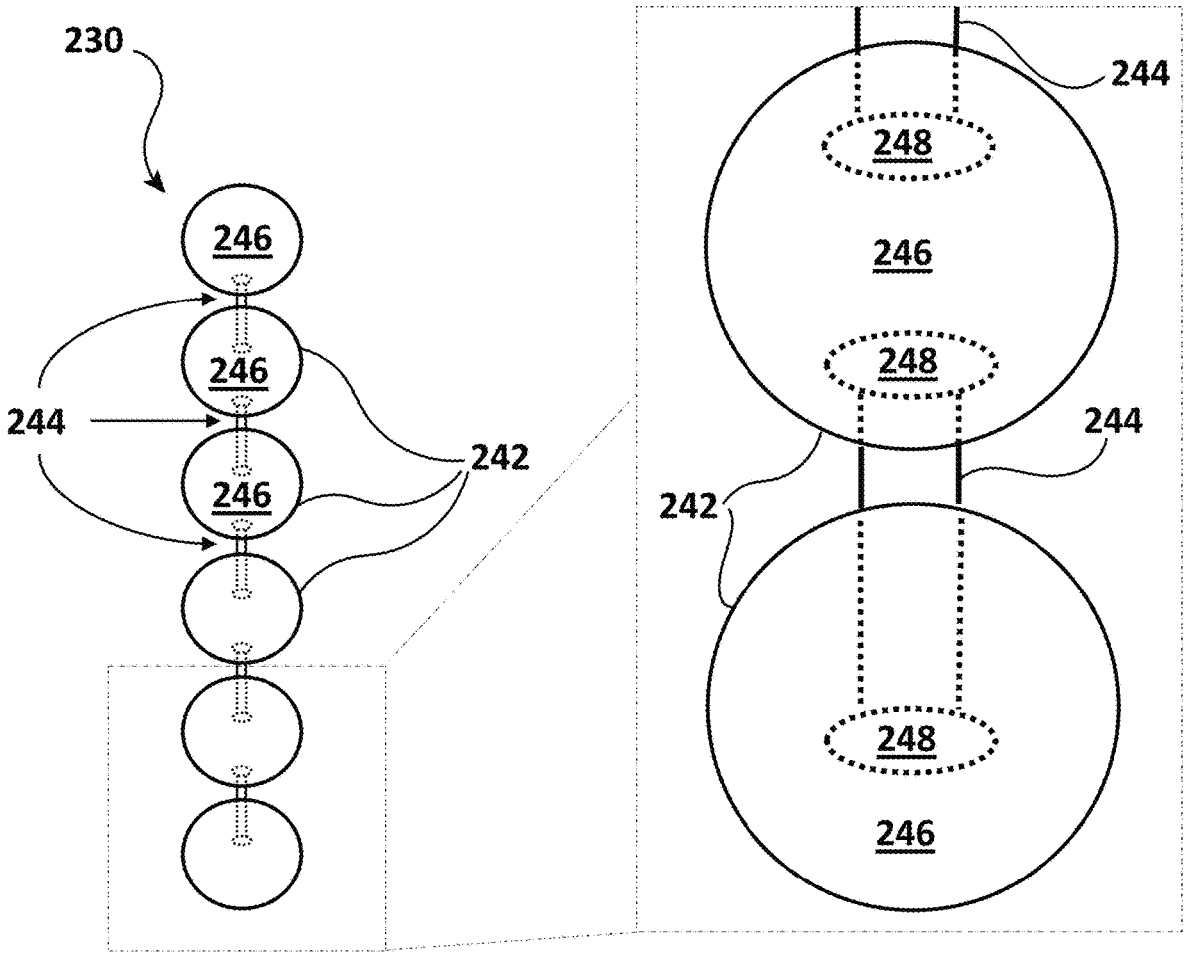
FIG. 2B is a diagram of a flexible line in a contracted configuration according to the embodiment of FIG. 2A.
Figure 2C:
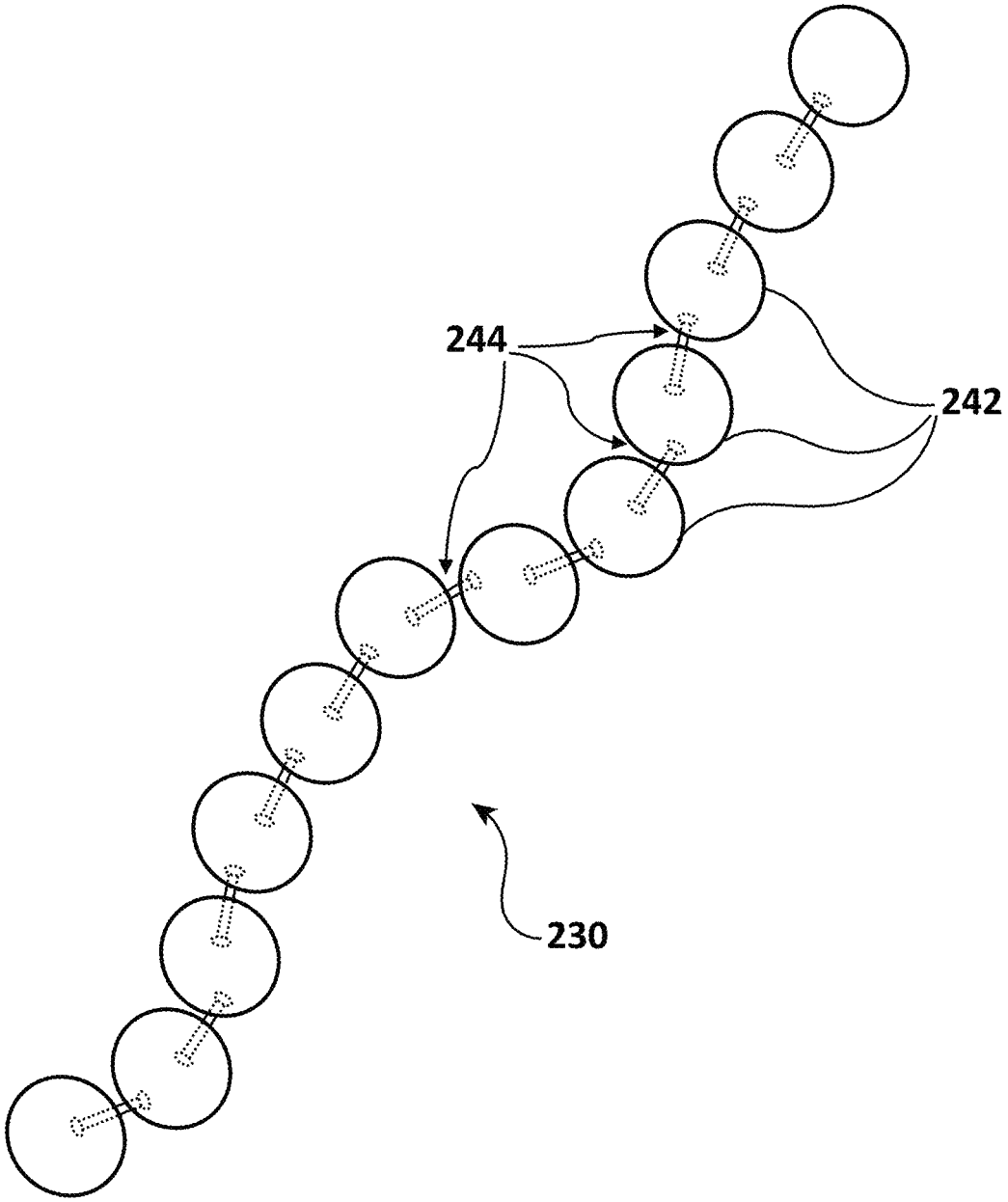
FIG. 2C is a diagram of a flexible line in the form of a flexible ball-chain according to an embodiment of the disclosure.

According to the embodiment of FIGS. 2A-2C, the flexible line 230 may comprise a ball-chain 240, including a plurality of ball elements 242 and connecting segments 244. The ball elements 242 may comprise a bead or ball defining an interior portion 246. As may be seen in the exploded portion of FIG. 2A, the connecting segments 244 may be attached to the ball elements 242 by the interior portion 246 receiving a retaining end 248 of the connecting segments 244. For example, the retaining end 248 may include an increased thickness relative to the connecting segments 244, a hook, a transversely oriented segment, or the like contained within the interior portion 246 of the ball elements 242.

The ball-chain 240 may have a varying length or expansion, for example where the retaining end 248 is capable of moving within the ball elements 242. In embodiments, the connecting segments 244 and/or the ball elements 242 may be formed of a rigid material that does not elastically deform. The ball-chain 240 may be compressed by substantially linear movement of the connecting segments 244 within the ball elements 242 such that the ball elements 242 may be brought closer together or farther apart, as seen in a comparison of the ball-chain 240 in an expanded and/or extended state according to the diagram of FIG. 2A and the ball-chain 240 in an expanded and/or extended state according to the diagram of FIG. 2B. In like manner, the ball-chain 240 may be flexible within a predefined range of motion by substantially angular movement of the connecting segments 244 within the ball elements 242, as seen in a comparison of the ball-chain 240 in a linear state according to the diagram of FIG. 2A and the ball-chain 240 in a curved state according to the diagram of FIG. 2C.

Embodiments of a ball-chain 240 may comprise connecting segments 244 and/or ball elements 242 formed of an elastic material, such that the ball-chain 240 may be compressed, expanded, extended, retracted, contracted or flexibly adjusted within a predefined range based on the properties of the elastic material. Combinations of elastic and rigid materials are also contemplated, for example where the connecting segments 244 and/or the ball elements 242 may be formed of a rigid material core under an elastic material, and/or where one or more of the connecting segments 244 and/or the ball elements 242 may be formed of a rigid material while the other may be formed of an elastic material.

Figure 2D:
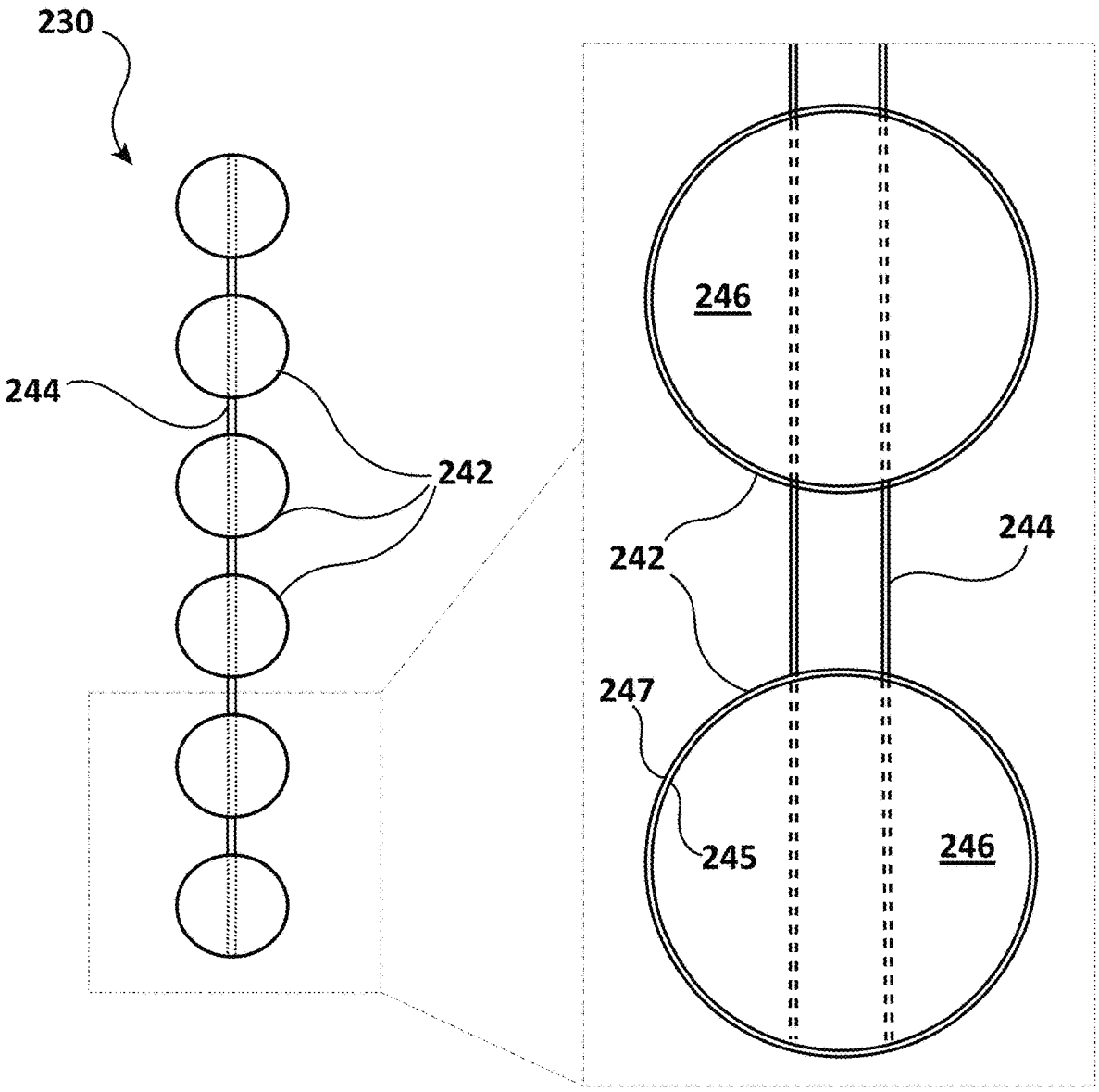
FIG. 2D is a diagram of a flexible line having a single connecting segment according to an embodiment of the disclosure.

While depicted as a plurality of connecting segments 244, with each connecting segment 244 attaching two ball elements 242, a ball-chain 240 according to embodiments of the disclosure may employ varying arrangements for forming a flexible line 230. In some aspects, a single connecting segment may be provided for connecting three or more ball elements or even all of the ball elements 242 of the ball-chain 240. For example, one or more filament lines, a wire or similar element may be extended through three or more of the ball elements 242 and connected to a final ball element 242, to itself, or to another connecting segment. FIG. 2D illustrates an example of a ball-chain 240 having a single connecting segment 244 for connecting a plurality of ball elements 242.

Use of a ball-chain 240 in a projectile 100 according to embodiments of the instant disclosure is advantageous due to the substantial difference in an extended length and a retracted length. For example, a 12-inch length of no. 3 ball-chain (having ball elements with a diameter of 3/32") may be contained within a .68 caliber ball according to various disclosed embodiments. As such, in this example, upon impact with a target and rupture of the shell 110, the flexible line 230 may extend an impact zone from the 0.68 inches of the shell to the 12 inches of the ball-chain, dramatically increasing the likelihood of the flexible line 230 coming into contact and entangling with a rotating element of the target. The change in length and impact zone further increases the disruption, impairment, and/or damage inflicted to the target and/or its rotational element. These advantages are realized without any reduction in aerodynamic properties of the shell, thereby also maintaining an improved range, velocity and accuracy of a ball or bullet projectile in addition to the advantages of increased length and impact zone.

A flexible line according to the present disclosure may be configured to be retained in the shell 110, such as by coiling, collapsing, retracting, or compressing the flexible line within the interior volume 120 of the shell 110. A maximum extended length of the flexible line may be configured for certain materials and arrangements of a flexible line, as well as for a size and shape of a shell 110. For example, the flexible line may be extendable to a maximum length in a range of 20 to 40 cm or in a range of 25 to 35 cm for a ball-chain or similar flexible line that has a greater diameter, while the flexible line may be extendable to a maximum length in a range of 60 to 120 cm, in a range of 70 to 110 cm, or in a range of 80 to 90 cm for a monofilament line or similar flexible line that has a smaller diameter. According to varying embodiments, the flexible line may fill the interior volume 120 or may fill only a portion of the interior volume 120. Embodiments of the shell 110 may be configured to secure the flexible line in the interior volume under a retentive pressure and/or elastic force, whether by including internal arms or ribs or by configuring an interior volume of the shell, such that the flexible line is not capable of moving or is only capable of very little movement in the shell 110, advantageously improving accuracy of the projectile 100.

The flexible line may be launched or projected to a target while contained within the shell 110, advantageously benefiting from aerodynamic properties of the shell and conventional launch systems or firearms. In certain aspects the projectile may be configured to have a total weight of at least 2 grams, of at least 2.5 grams, or of approximately 3 grams. The projectile may be configured to have a total weight in a range of 2 to 7.5 grams, or more particularly in a range of 2.5 to 3.5 grams, or a total weight of about 3 grams. As the weight of the projectile is configured, it has been discovered that the weight may be tuned to the properties of a weapon or device launching the projectiles. For example, with certain conventional pneumatic weapons, a balance of accuracy, range, and velocity is best as the weight approaches about 3 grams, while this weight also helps prevent serious injury from the projectile for living targets that may be inadvertently struck. As would be clear from the disclosure to one skilled in the art, changes in the desired weight may result from the use of certain weapons or launching instruments, and/or for varied shapes of the shell 100.

Upon impact and rupture of the shell with a target, the flexible line advantageously increases in length by uncoiling, extending and/or expanding under momentum of the launch, increasing an area of effect on the target. The flexible line may be configured for entangling with a rotating element of the target, such that a strength and/or weight of the flexible line impedes the rotating element by bending, breaking, or otherwise impairing rotation of the rotating element. In like manner, operation of the target may be impeded by the flexible line entangling with another portion of the target, such as an arm portion or a body portion, such that a strength and/or weight of the flexible line impedes the target by bending or breaking the portion of the target or otherwise impairs operation of the target by causing drag and/or balance issues.

The flexible line may comprise a metal material, such as one or more of steel, aluminum, nickel, titanium, and alloys or combinations thereof. Other materials such as wood or plastic may also be employed. In various embodiments, the flexible line may have a constant hardness and/or weight or may be configured with variable hardness and/or weight. For example, the flexible line may comprise a core material 245 surrounded by a peripheral material 247, the core material having a greater hardness than the peripheral material. Harder materials may be more effective at breaking or bending a rotating element of the target once entangled, while softer materials may be more effective at catching and entangling the rotating element.

The flexible line may be configured to increase chances for entanglement with the target or for increasing impairment of the target once entangled, such as by employing an uneven distribution of weight, weighted ends, and/or incorporating the flexible line in varying shapes and patterns, including nets, webs and the like. In like manner, the flexible line may include materials thereon designed to increase retention and damage against the target, such as an adhesive or sticky substance, a soft outer material in which a rotating element may become stuck, spikes, blades, hooks, and/or similar components/materials. These materials may be provided at only certain portions of the flexible line or distributed across the flexible line.

Figure 3A:
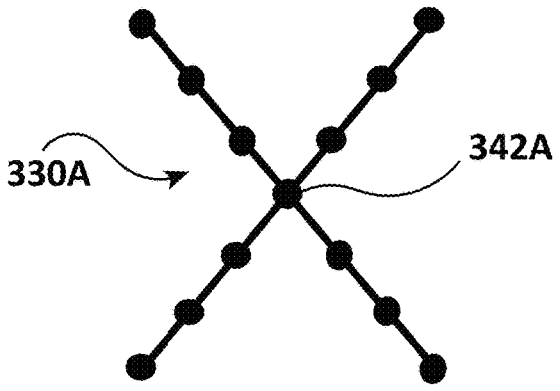
FIG. 3A is a diagram of a flexible line having an X-shaped arrangement according to an embodiment of the disclosure.
Figure 3B:
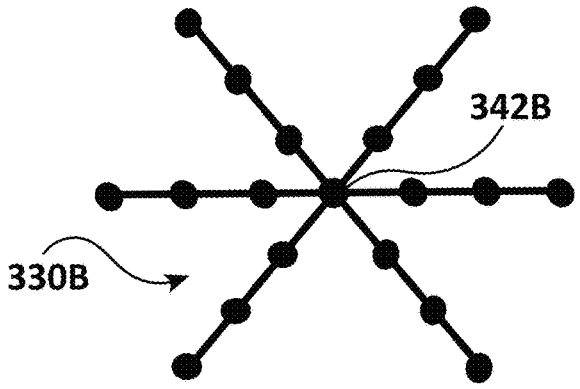
FIG. 3B is a diagram of a flexible line having a star-shaped arrangement according to an embodiment of the disclosure.
Figure 3C:
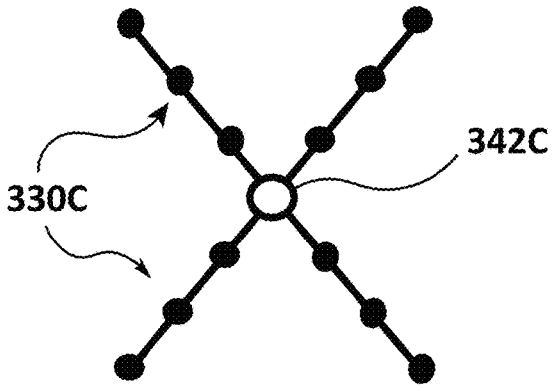
FIG. 3C is a diagram of a flexible line having a ring element according to an embodiment of the disclosure.
Figure 3D:
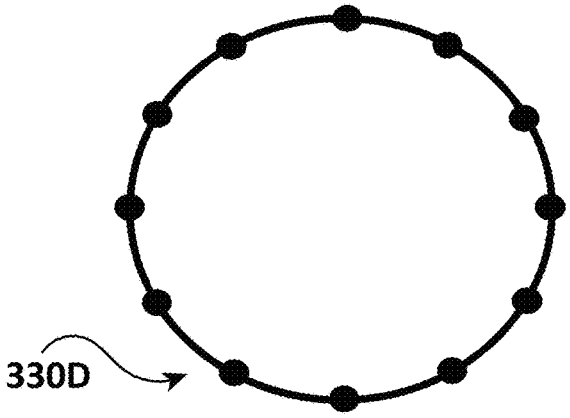
FIG. 3D is a diagram of a flexible line having circular-shaped arrangement according to an embodiment of the disclosure.

Turning to FIGS. 3A-3D and 4A-4D, a variety of different shapes and configurations of a flexible line are shown. As shown in FIGS. 3A and 3B, a flexible line 330A, 330B may form an X-shape, a star shape, or similar arrangement, for example connected at a ball element 342A, 342B. FIG. 3C illustrates a variation where a ring element 342C is provided for connecting portions of the flexible line 330C. While four segments are shown, embodiments may include one, two, three, four or more segments. The embodiment of FIG. 3D shows a flexible line 330D forming a closed circle. While illustrated as comprising ball-chain elements, the embodiments of the current disclosure, including those of FIGS. 3A-3D, may be employed with another flexible line, such as a monofilament line, a chain of links, loops, rings, hooks or similar elements, rope, or the like, or may include a combination of different flexible line types.

Embodiments of the flexible line according to the current disclosure may include links, balls or other weighted elements as has been discussed. Further, embodiments may be configured with varying weight and/or thickness distributions for increasing the spread of the flexible line upon release from the shell. In various embodiments, the flexible line may comprise at least two distal ends connected by a center portion, wherein a linear density of the flexible line increases from the center portion to each of the at least two distal ends.

Figure 4A:
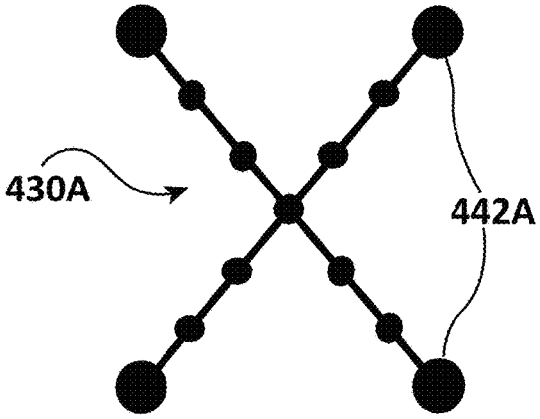
FIG. 4A is a diagram of a flexible line having varying weights or sizes of elements according to an embodiment of the disclosure.
Figure 4B:
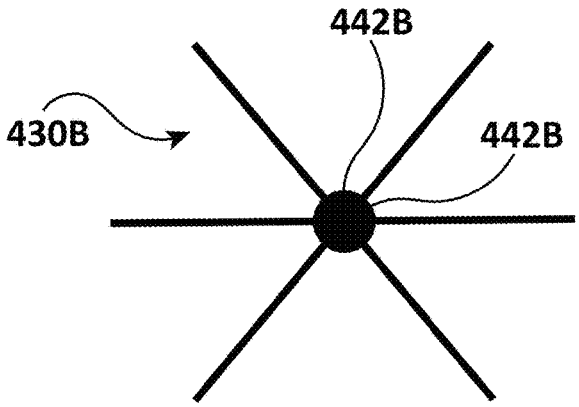
FIG. 4B is a diagram of a flexible line with a single weighted element connecting the flexible line according to an embodiment of the disclosure.
Figure 4C:
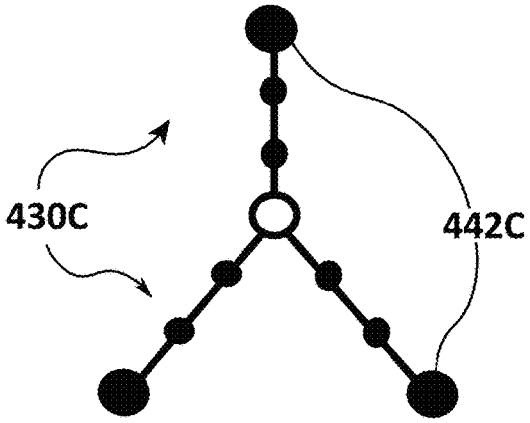
FIG. 4C is a diagram of a flexible line having varying weights or sizes of elements and a ring element according to an embodiment of the disclosure.
Figure 4D:
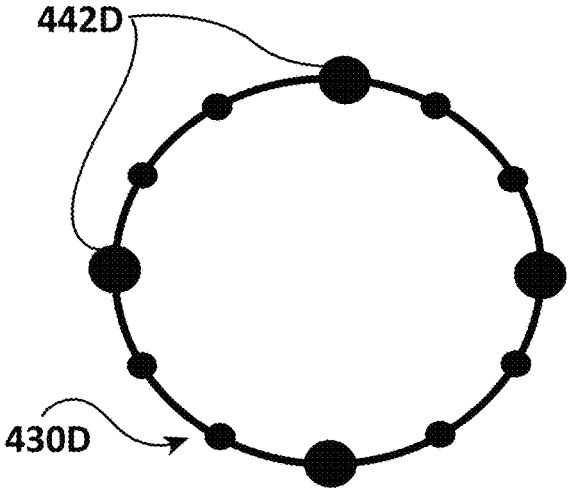
FIG. 4D is a diagram of a flexible line having varying weights or sizes of elements in a circular-shaped arrangement according to an embodiment of the disclosure.

In the examples of FIGS. 4A, 4C and 4D, ball elements 442A, 442B, 442C, 442D may be provided with an increased size and/or weight relative to other ball elements, such as at the terminal ends of the flexible line 430A, 430C. FIG. 4B illustrates a flexible line comprising a plurality of line segments 430B connected to a ball element 442B. In this embodiment, the flexible line segments 430B may be a ball-chain or another element, such as monofilament line, chain, rope, or the like, while the ball element 442B may be replaced with a ring or another connecting element. In some examples, individual weighted elements of the flexible line, such as balls, beads or links, may have a diameter in a range of 0.5 to 5 mm, in a range of 1 to 4 mm, or in a range of 2 to 3 mm.

In additional aspects of the disclosure, the projectile may be configured with properties specific to an intended use. In some examples, embodiments of the projectile may further include an inhibiting substance in the form of a lubricant material, a conductive material, a piezoelectric material, and/or a radiation impeding material. The inhibiting substance may be configured to further impair an element of an electrical target, such as sensors, propellers, drive shafts, cameras, and/or electrical systems of electrical targets. Embodiments having a lubricant material may include polytetrafluoroethylene, oils, and/or graphite, such as for causing a rotating element of the target to rotate out of control, while a radiation impeding material may include aluminum doped zinc oxide, germanium, indium tin oxide, samarium oxide, praseodymium oxide, photoluminescent pigment, zinc, and/or bismuth, such as for impeding or blinding sensor systems or the like. The inhibiting substance may be provided in the interior volume and surround the flexible line and/or be provided within a portion of the flexible line, for example inside one or more frangible balls of a ball chain, such that the flexible line may increase a spread and/or release of the inhibiting substance.

In various embodiments, properties of the flexible line may be configured for a specific purpose. In some examples, the flexible line may include magnetic materials, such as for repelling opposite ends of the flexible line from each other or for attracting the flexible line to a target. Some embodiments may include sharpened edges or protrusions as part of the flexible line, such as configured for damaging a tire, a propeller, or otherwise catching on a target, or for better rupturing the shell. Still more embodiments may include a pressure sensitive explosive configured to spread the flexible line upon release from the shell.

Notably, the embodiments of the flexible line according to the current disclosure may incorporate some or all of the various features and advantages described. As such, the disclosure of one type or configuration does not limit the disclosure, but merely provide exemplary examples that may be divided or combined for particular uses, as would be understood by one skilled in the art.

Figure 5:
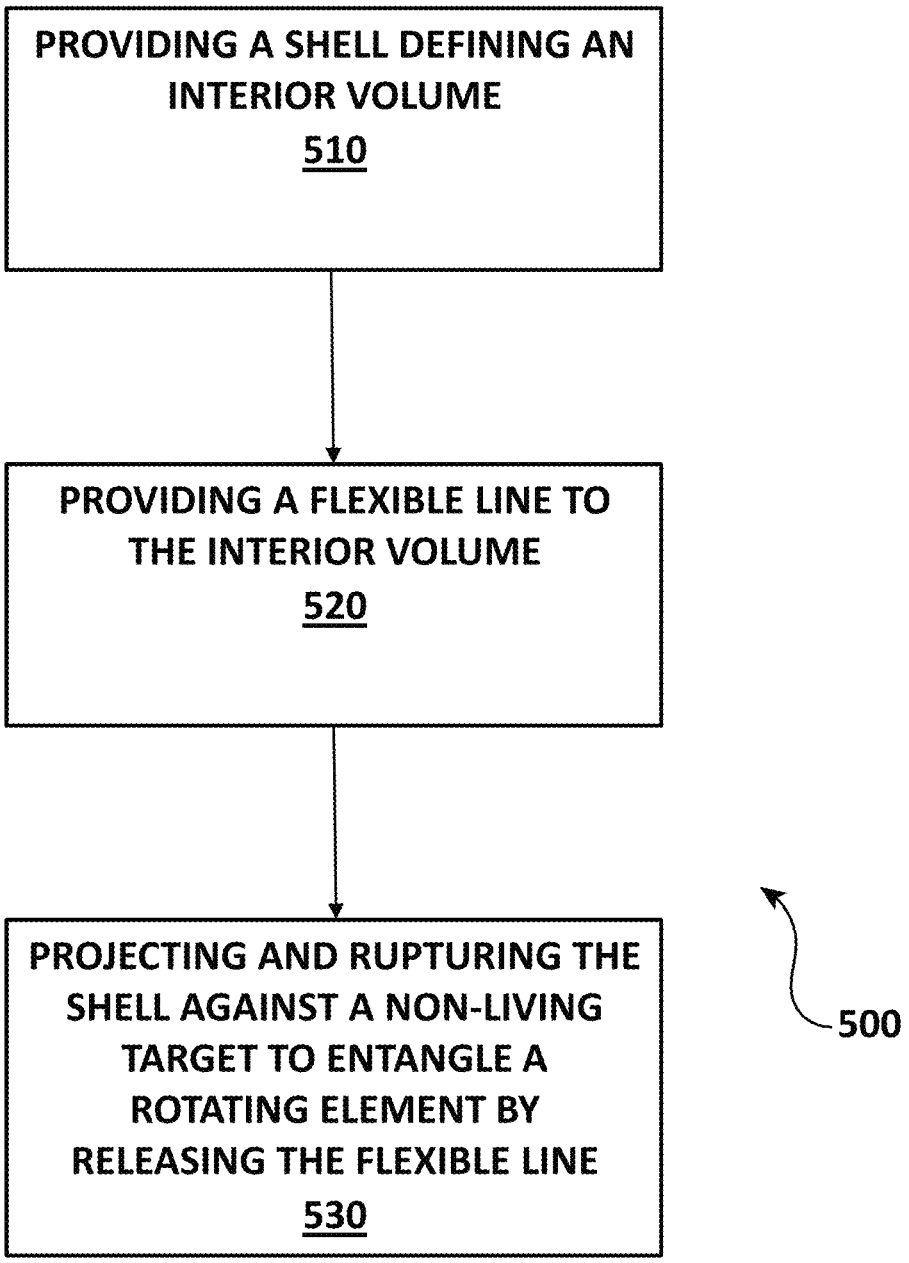
FIG. 5 is a flow diagram of a method for disrupting operation of a non-living target according to an embodiment of the disclosure.

FIG. 5 illustrates steps of a method 500 for disrupting an electrical target, including a step 510 of providing a shell defining an interior volume therein. As discussed with respect to embodiments of a shell, the shell may be assembled from multiple pieces, such as by retentive elements, adhesive, or the like. Accordingly, a step 520 of providing a flexible line to the interior volume may be performed such that the shell encloses or otherwise retains the flexible line within the interior volume. A step 530 of projecting, firing or otherwise launching the shell against a non-living target may be performed such that the shell ruptures on impact with the non-living target and releases the flexible line, the flexible line configured to tangle with a rotating element of the non-living target or otherwise to foul the rotating element. In some examples, a rotating element may comprise a propeller, a wheel, a track, a driveshaft, or similar element of an electrical device, drone or robot.

Embodiments of the projectile 100 of the current disclosure are configured to be fired or otherwise propelled against a target and to disperse the flexible line against the target during and after impact therewith. Embodiments of the current disclosure provide an improved impact zone against non-living targets, and especially against rotating elements of such targets, while advantageously presenting low risk of collateral damage. Surprisingly, the disclosed embodiments are easily configurable to the specifications of existing launching devices or firearms, such that the embodiments do not require specialized equipment or training.

Figure 6A:
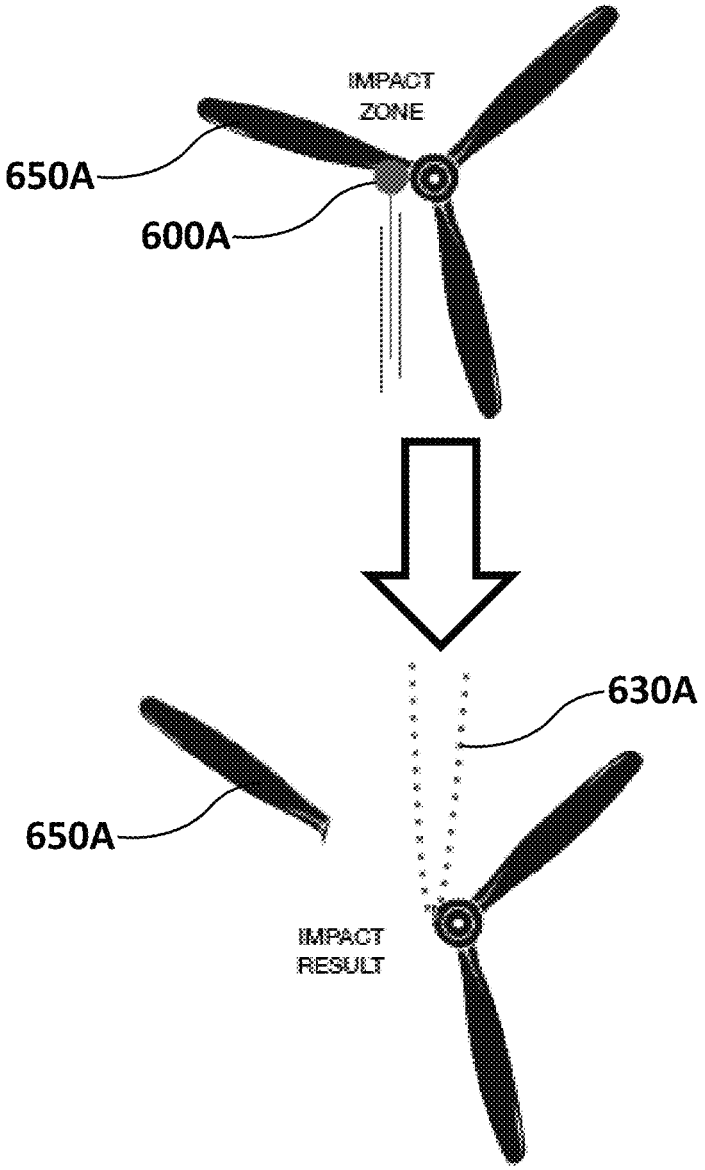
FIG. 6A is a diagram illustrating an inner strike impact of a disruptive projectile embodiment of the disclosure against a target.
Figure 6B:
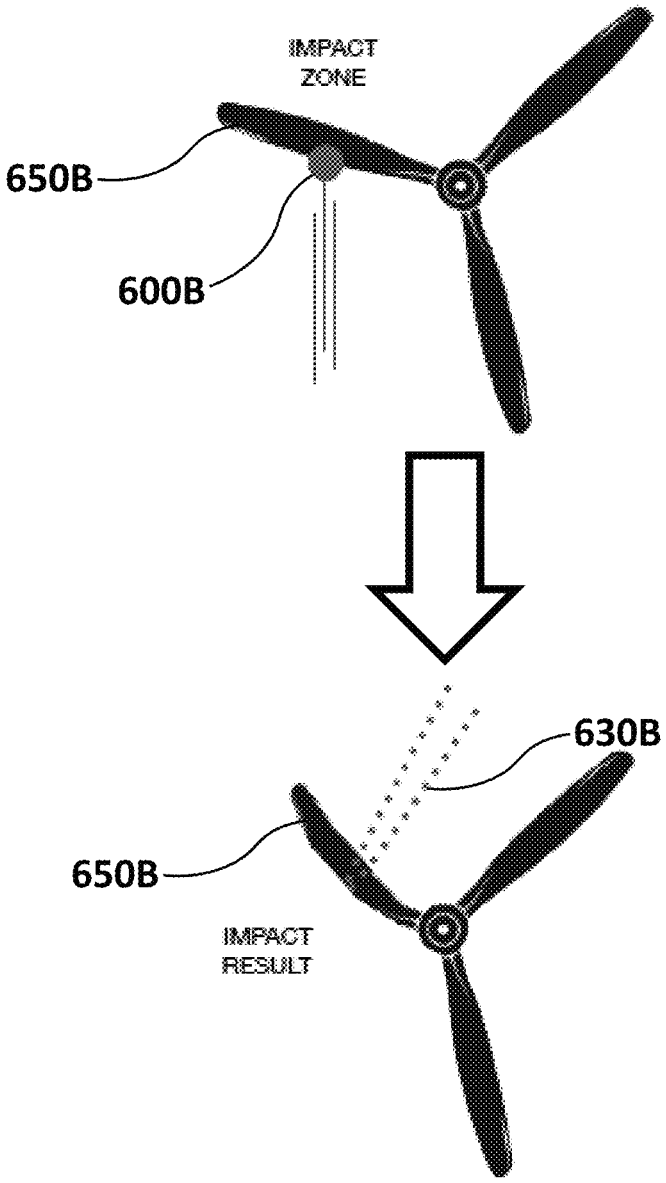
FIG. 6B is a diagram illustrating a middle strike impact of a disruptive projectile embodiment of the disclosure against a target.
Figure 6C:
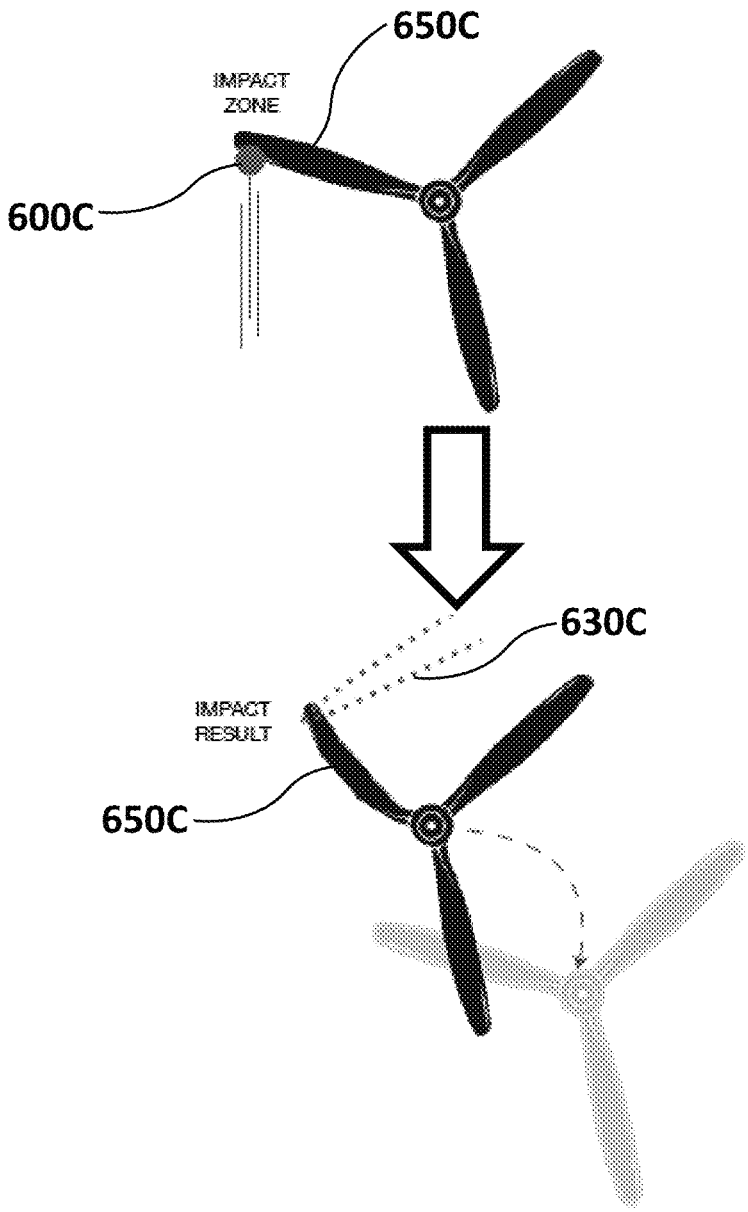
FIG. 6C is a diagram illustrating an outer strike impact of a disruptive projectile embodiment of the disclosure against a target.

FIG. 6A illustrates an inner strike of a projectile 600A of the current disclosure against a rotating element of a target in the form of a propeller 650A. As shown in FIG. 6A, an inner strike of projectile 600A in an area of a propeller 650A hub may allow the flexible line 630A to exert a contrary force and/or drag on the propeller 650A sufficient to cause the propeller to break under the strain of its own high spin speed and/or the restraining force of the flexible line 630A, resulting in destruction of the propeller 650A or at least a part of the propeller 650A. FIG. 6B illustrates a middle strike of a projectile 600B of the current disclosure against a rotating element of a target in the form of a propeller 650B. As shown in FIG. 6B, a middle strike of projectile 600B in a middle area of a propeller 650B may allow the flexible line 630B to exert a contrary force and/or drag on the propeller 650B sufficient to cause the propeller to bend or deform under the strain of its own high spin speed and/or the restraining force of the flexible line 630B, resulting in an impaired operation of the propeller 650B. As shown in FIG. 6C, an outer strike of projectile 600C in a terminal area of a propeller 650C may allow the flexible line 630C to exert a contrary force and/or drag on the propeller 650C sufficient to cause the propeller to deform and/or detach under the strain of its own high spin speed and/or the restraining force of the flexible line 630C, resulting in the complete loss of the propeller 650C or at least an impaired operation of the propeller 650C.

While shown in FIGS. 6A-6C impacting the propeller 650A, 650B, 650C with the shell intact, it should be noted that the flexible line 630A, 630B, 630C may be configured to impact and/or entangle the propeller 650A, 650B, 650C even when the projectile impacts another portion of the target and ruptures the shell thereon. For example, the flexible line 630A, 630B, 630C may be configured to spread, extend and/or expand against the target when the shell impacts and ruptures. This increased spread and length increases the chances of the flexible line 630A, 630B, 630C impacting a rotating element, such as a propeller 650A, 650B, 650C. The flexible line 630A, 630B, 630C may be configured for easy movement along a body of a target, such as with ball elements, beads, links or similar weighted elements, further increasing opportunities for the flexible line 630A, 630B, 630C to reach and impact a rotating element. Notably, such ball elements, beads, links or other weighted elements do not move easily off of a rotating element, such as a propeller 650A, 650B, 650C due to one or more of the expanded or extended length of the flexible line, narrow connecting segments between larger weighted elements, irregular surface areas for catching narrow propellers, and the high speed of the rotating element.

Advantageously, rather than simply inflicting general mechanical trauma on the target, the flexible line expands and/or extends against the target and increases the likelihood of being drawn against or impacting a rotating element. Such contact or impact allows the flexible line to entangle or otherwise interrupt normal operation of the rotating element, which is generally more susceptible to trauma than a body of a non-living target, such as a drone. Further, damage to a rotating element has a more significant impact on operation of the non-living target, potentially rendering it uncontrollable and causing it to fall and/or crash. Importantly, while having a high likelihood of causing significant damage to non-living targets, the projectiles of the instant disclosure pose very little risk to living targets. Specifically, the projectile is unlikely to penetrate the skin and cause anything more than superficial pain or wounds on a direct strike, while the extension and spread of the flexible line after impact causes the flexible line to decelerate dramatically from air resistance when separated from the target. Accordingly, contact with the flexible line after separation from the target would be minor and unlikely to cause injury.

As previously indicated, it will be appreciated that embodiments of projectiles of the present disclosure may be adapted for use according to the requirements and bore of known firearms, weapons, launchers and related instruments. As such, the projectiles may be dimensioned for any conventional caliber or gauge, such as a .43 caliber, .50 caliber, .68 caliber, .71 caliber, etc. A size and shape of a bore or barrel of a weapon may vary according to attributes of an intended target, and similar variations may be applied to a size and shape of the shell, as would be understood by one skilled in the art from the present disclosure.

Figure 7:
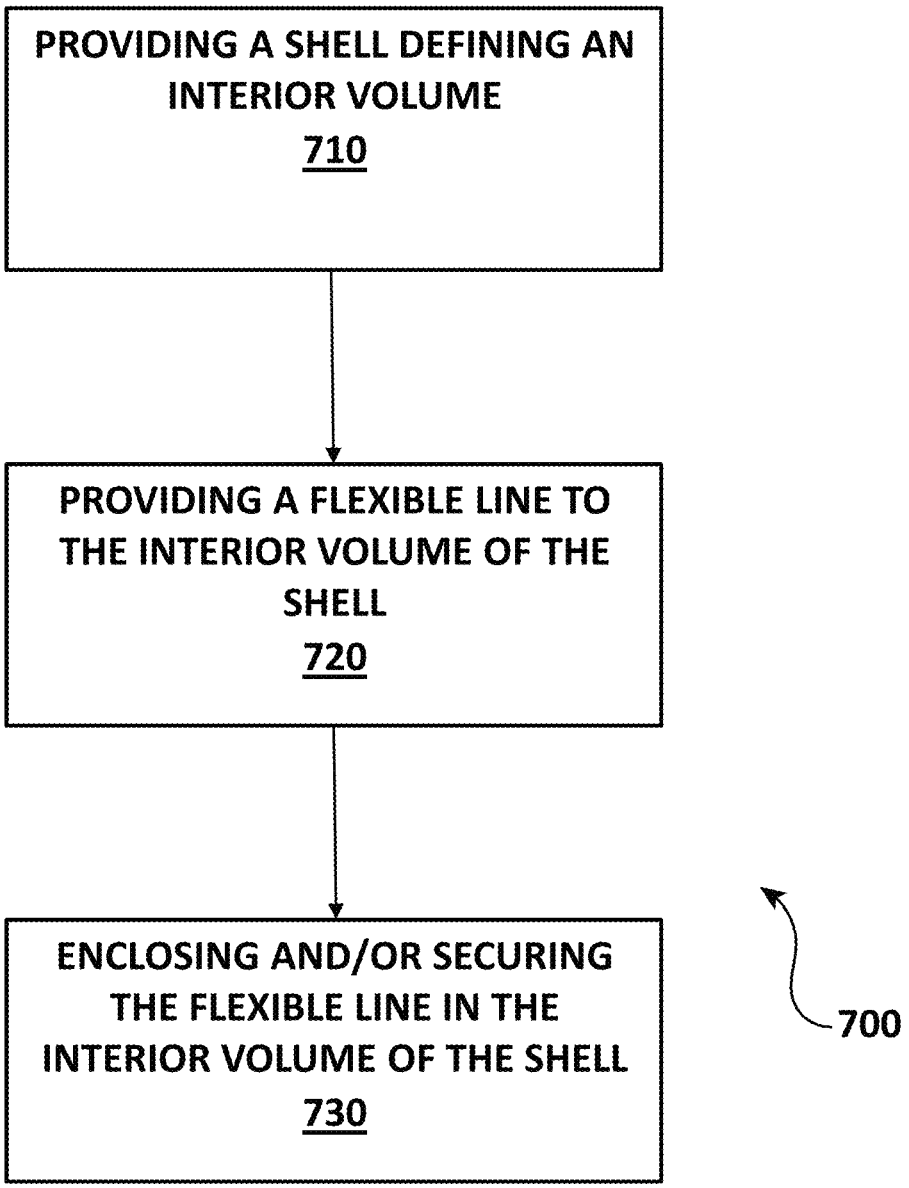
FIG. 7 is a flow diagram of a method for forming a disruptive projectile according to an embodiment of the disclosure.

FIG. 7 illustrates a flow chart of a method 700 for forming projectiles of the current disclosure. According to steps of the disclosed method, a shell of a projectile is provided 710 defining an interior volume therein. The shell may be provided in the form of a pre-manufactured ball or even pre-manufactured portions of a ball, such as opposing halves of a ball including retentive elements for interlocking the halves together.

A flexible line may be provided 520 to the cavity. According to varying embodiments of the method, the flexible line may substantially fill all or only a portion of the interior volume. Providing the flexible line to the interior volume may include coiling the flexible line in the interior volume, contracting (retracting, compressing, etc.) the flexible line to reduce its length, and/or securing 530 the flexible line in the interior volume under a retentive force or pressure, such as by tightly interlocking halves of the shell together around the flexible line and/or applying an adhesive to close the shell.

It is to be understood from the current disclosure that the features of the illustrated embodiments may be combined to meet the requirements or characteristics of a particular target, such as accommodating for rotating elements of varying thickness and strength. Accordingly, embodiments according to the current disclosure may incorporate variations in size, shape, and/or materials, as conventionally understood in view of the current disclosure or otherwise in whole or in part from one embodiment to another.

Various alterations and/or modifications of the inventive features illustrated herein, and additional applications of the principles illustrated herein, which would occur to one skilled in the relevant art and having possession of this disclosure, can be made to the illustrated embodiments without departing from the spirit and scope of the invention as defined by the claims, and are to be considered within the scope of this disclosure. Thus, while various aspects and embodiments have been disclosed herein, other aspects and embodiments are contemplated. While a number of methods and components similar or equivalent to those described herein can be used to practice embodiments of the present disclosure, only certain components and methods are described herein.

The present disclosure may be embodied in other specific forms without departing from its spirit or essential characteristics. The described embodiments are to be considered in all respects only as illustrative and not restrictive. The scope of the invention is, therefore, indicated by the appended claims rather than by the foregoing description. While certain embodiments and details have been included herein and in the attached disclosure for purposes of illustrating embodiments of the present disclosure, it will be apparent to those skilled in the art that various changes in the methods, products, devices, and apparatus disclosed herein may be made without departing from the scope of the disclosure or of the invention, which is defined in the appended claims. All changes which come within the meaning and range of equivalency of the claims are to be embraced within their scope.

The invention claimed is:

1. A projectile comprising:

a shell defining an interior volume within, the shell configured to rupture upon impact with a target; and a flexible line contained within the interior volume of the shell;

wherein the flexible line comprises a core material surrounded by a peripheral material, the core material having a greater hardness than the peripheral material.

2. The projectile of claim 1, wherein the flexible line comprises a connected series of weighted elements.

3. The projectile of claim 2, wherein the flexible line comprises a chain.

4. The projectile of claim 2, wherein the flexible line comprises a ball-chain.

5. The projectile of claim 1, wherein the flexible line comprises a flexible wire.

6. The projectile of claim 1, wherein the flexible line comprises at least two distal ends connected by a center portion, wherein a linear density of the flexible line increases from the center portion to each of the at least two distal ends.

7. The projectile of claim 1, wherein the flexible line comprises a metal material, the metal material comprising one or more of steel, aluminum, nickel, titanium, and alloys thereof.

8. The projectile of claim 4, wherein the ball-chain comprises a plurality of ball segments and a plurality of links, each of the plurality of ball segments being connected to another of the plurality of ball segments by one of the plurality of links.

9. The projectile of claim 8, wherein at least one of the plurality of ball segments encloses an inhibiting substance, the inhibiting substance comprising a lubricant material, a conductive material, a piezoelectric material, and/or a radiation impeding material.

10. The projectile of claim 9, wherein the inhibiting substance comprises the lubricant material, the lubricant material comprising polytetrafluoroethylene or graphite.

11. The projectile of claim 9, wherein the inhibiting substance comprises the radiation impeding material, the radiation impeding material comprising aluminum doped zinc oxide, germanium, indium tin oxide, samarium oxide, praseodymium oxide, photoluminescent pigment, zinc, and/or bismuth.

12. The projectile of claim 1, further comprising an inhibiting substance within the interior volume of the shell.

13. The projectile of claim 1, wherein the flexible line is extendable to a maximum length in a range of 25 to 35 cm or in a range of 70 to 110 cm.

14. The projectile of claim 4, wherein individual balls of the ball-chain have a diameter in a range of 1 to 4 mm.

15. The projectile of claim 1, wherein the shell comprises a .43 caliber ball, a .50 caliber ball, or a .68 caliber ball.

16. The projectile of claim 1, wherein the shell has a wall thickness in a range of 0.5 to 1.5 mm.

17. The projectile of claim 1, the projectile having a weight in a range of 2.5 to 7.5 grams.

18. The projectile of claim 1, wherein the shell has a diameter in a range of 12 to 18 mm.

19. A projectile comprising:

a shell defining an interior volume within, the shell configured to rupture upon impact with a target; and a flexible line contained within the interior volume of the shell;

wherein the flexible line comprises a ball-chain, the ball-chain comprising a plurality of ball segments and a plurality of links, each of the plurality of ball segments being connected to another of the plurality of ball segments by one of the plurality of links, wherein at least one of the plurality of ball segments encloses an inhibiting substance, the inhibiting substance comprising a lubricant material, a conductive material, a piezoelectric material, and/or a radiation impeding material.

* * * * *